US008851182B2

(12) United States Patent
Nguyen et al.

(10) Patent No.: US 8,851,182 B2
(45) Date of Patent: Oct. 7, 2014

(54) WELLHEAD HANGER SHOULDER

(75) Inventors: Dennis P. Nguyen, Pearland, TX (US); Kirk P. Guidry, Cypress, TX (US); Haw Keat Lim, Jurong Industrial Estate (SG)

(73) Assignee: Cameron International Corporation, Houston, TX (US)

( * ) Notice: Subject to any disclaimer, the term of this patent is extended or adjusted under 35 U.S.C. 154(b) by 823 days.

(21) Appl. No.: 12/934,312

(22) PCT Filed: Mar. 27, 2009

(86) PCT No.: PCT/US2009/038520

§ 371 (c)(1), (2), (4) Date: Jun. 16, 2011

(87) PCT Pub. No.: WO2009/120935

PCT Pub. Date: Oct. 1, 2009

(65) Prior Publication Data

US 2011/0240307 A1 Oct. 6, 2011

Related U.S. Application Data

(60) Provisional application No. 61/040,328, filed on Mar. 28, 2008.

(51) Int. Cl.

| | |
|---|---|
| ***E21B 33/043*** | (2006.01) |
| ***E21B 33/035*** | (2006.01) |
| ***E21B 23/01*** | (2006.01) |
| ***E21B 43/10*** | (2006.01) |
| ***E21B 33/04*** | (2006.01) |
| ***E21B 33/076*** | (2006.01) |
| ***E21B 43/08*** | (2006.01) |

(52) U.S. Cl.

CPC ..... *E21B 33/043* (2013.01); *E12B 33/035* (2013.01)

USPC ..... 166/348; 166/75.14; 166/351; 166/360; 166/378; 166/382

(58) Field of Classification Search

USPC ..... 166/338, 348, 351, 360, 368, 378, 379, 166/382, 85.1; 285/123.1

See application file for complete search history.

(56) References Cited

U.S. PATENT DOCUMENTS 3,086,590 A * 4/1963 Jackson, Jr. et al. ..... 166/348
3,299,954 A * 1/1967 Williams et al. ..... 166/298

(Continued)

OTHER PUBLICATIONS

PCT/US2009/038520 Search Report and Written Opinion, Nov. 6, 2009 ( 11 p.).

*Primary Examiner* — Matthew Buck
*Assistant Examiner* — Edwin Toledo-Duran
(74) *Attorney, Agent, or Firm* — Chamberlain Hrdlicka

(57) ABSTRACT

A well production system including a wellhead and a first casing string supported from a first casing hanger landed on a shoulder in the wellhead bore. A loading shoulder assembly is installable in the wellhead and includes an energizing ring, a loading ring threaded into the interior of the energizing ring, a lock ring, and a hold-down ring threaded into the interior of the loading ring. The hold-down ring engages the first casing hanger to prevent rotation of the hold-down ring and restrain rotation of the loading ring. The lock ring is expandable from an unset position into supporting engagement with the wellhead in a set position upon rotation of the energizing ring. The hold-down ring is also moveable axially out of the loading ring to restrain the first casing hanger.

18 Claims, 7 Drawing Sheets

(56) References Cited

U.S. PATENT DOCUMENTS

| | | | | | |
|---|---|---|---|---|---|
| 3,382,921 | A | * | 5/1968 | Todd | 166/348 |
| 3,404,736 | A | * | 10/1968 | Nelson et al. | 166/89.1 |
| 3,457,992 | A | * | 7/1969 | Brown | 166/335 |
| 3,543,847 | A | * | 12/1970 | Haeber | 166/348 |
| 3,561,527 | A | * | 2/1971 | Nelson | 285/123.2 |
| 4,089,377 | A | * | 5/1978 | Chateau | 166/382 |
| 4,139,058 | A | * | 2/1979 | Gano | 166/360 |
| 4,167,970 | A | * | 9/1979 | Cowan | 166/208 |
| 4,252,187 | A | * | 2/1981 | Wilson | 166/115 |
| 4,298,064 | A | * | 11/1981 | Lawson | 166/97.5 |
| 4,298,067 | A | * | 11/1981 | Lawson | 166/380 |
| 4,333,531 | A | * | 6/1982 | Lawson | 166/341 |
| 4,353,420 | A | * | 10/1982 | Miller | 166/382 |
| 4,416,472 | A | * | 11/1983 | Fowler et al. | 285/3 |
| 4,460,042 | A | * | 7/1984 | Galle, Jr. | 166/217 |
| 4,469,172 | A | | 9/1984 | Clark | |
| 4,528,738 | A | * | 7/1985 | Galle, Jr. | 29/416 |
| 4,540,053 | A | * | 9/1985 | Baugh et al. | 166/348 |
| 4,550,782 | A | * | 11/1985 | Lawson | 166/382 |
| 4,595,063 | A | * | 6/1986 | Jennings et al. | 166/382 |
| 4,615,544 | A | * | 10/1986 | Baugh | 285/18 |
| 4,661,016 | A | * | 4/1987 | Baugh et al. | 405/169 |
| 4,773,477 | A | * | 9/1988 | Putch | 166/206 |
| 4,815,770 | A | | 3/1989 | Hyne et al. | |
| 4,836,579 | A | * | 6/1989 | Wester et al. | 285/3 |
| 4,900,041 | A | * | 2/1990 | Hopkins et al. | 277/328 |
| 4,911,244 | A | * | 3/1990 | Hynes | 166/368 |
| 4,949,786 | A | * | 8/1990 | Eckert et al. | 166/208 |
| 5,020,593 | A | * | 6/1991 | Milberger | 166/208 |
| 5,094,297 | A | * | 3/1992 | Bridges | 166/382 |
| 5,110,144 | A | * | 5/1992 | Burton et al. | 277/328 |
| 5,127,478 | A | * | 7/1992 | Miller | 166/348 |
| 5,129,660 | A | * | 7/1992 | Taylor et al. | 277/328 |
| 5,174,376 | A | * | 12/1992 | Singeetham | 166/208 |
| 5,209,521 | A | * | 5/1993 | Osborne | 285/3 |
| 5,240,076 | A | * | 8/1993 | Cromar et al. | 166/382 |
| 5,255,746 | A | * | 10/1993 | Bridges | 166/348 |
| 5,307,879 | A | * | 5/1994 | Kent | 166/382 |
| 5,450,905 | A | * | 9/1995 | Brammer et al. | 166/348 |
| 5,544,707 | A | * | 8/1996 | Hopper et al. | 166/382 |
| 5,620,052 | A | * | 4/1997 | Turner | 166/348 |
| 6,003,602 | A | * | 12/1999 | Wilkins | 166/339 |
| 6,234,252 | B1 | * | 5/2001 | Pallini et al. | 166/345 |
| 6,520,263 | B2 | * | 2/2003 | June | 166/368 |
| 6,536,527 | B2 | * | 3/2003 | Munk et al. | 166/345 |
| 6,540,024 | B2 | * | 4/2003 | Pallini et al. | 166/348 |
| 6,715,554 | B1 | * | 4/2004 | Cunningham et al. | 166/348 |
| 7,040,412 | B2 | * | 5/2006 | DeBerry | 166/382 |
| 7,134,490 | B2 | | 11/2006 | Nguyen | |
| 7,380,607 | B2 | * | 6/2008 | Thomas | 166/348 |
| 7,500,524 | B2 | * | 3/2009 | Hopper et al. | 166/348 |
| 7,604,058 | B2 | * | 10/2009 | McGuire | 166/379 |
| 7,861,789 | B2 | * | 1/2011 | Nelson | 166/348 |
| 7,900,706 | B2 | * | 3/2011 | Ford | 166/348 |
| 2002/0040782 | A1 | * | 4/2002 | Rytlewski et al. | 166/341 |
| 2005/0006107 | A1 | | 1/2005 | Nguyen et al. | |

* cited by examiner

WELLHEAD HANGER SHOULDER

CROSS-REFERENCE TO RELATED APPLICATIONS

This application is a 35 U.S.C. §371 national stage application of PCT/US2009/038520 filed Mar. 27, 2009, which claims the benefit of U.S. Provisional Patent Application No. 61/040,328 filed Mar. 28, 2008, both of which are incorporated herein by reference in their entireties for all purposes.

BACKGROUND

In subsea or other underwater well drilling procedures an established practice is to run, land, and set casing hangers and annulus packoffs in a submerged wellhead housing by means of a running tool connected to a drill string or other pipe string. The hanger is run into the wellhead using the running tool until the hanger lands on a casing hanger shoulder in the wellhead or on a previously installed hanger. The packoff is then run in and set in the annulus between the hanger and the wellhead housing the hanger running tool to form a seal between the hanger and the wellhead. The hanger and packoff are each releasably connected to the running tool and the running tool is retrievable after the hanger and packoff have been set. However, once the running tool is retrieved, the hanger and/or the packoff may not be sufficiently restrained from above, even with an additional hanger later installed. Thus, there is the possibility that even a set packoff may travel within the wellhead and potentially compromise the integrity of the seal between the hanger and the wellhead.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
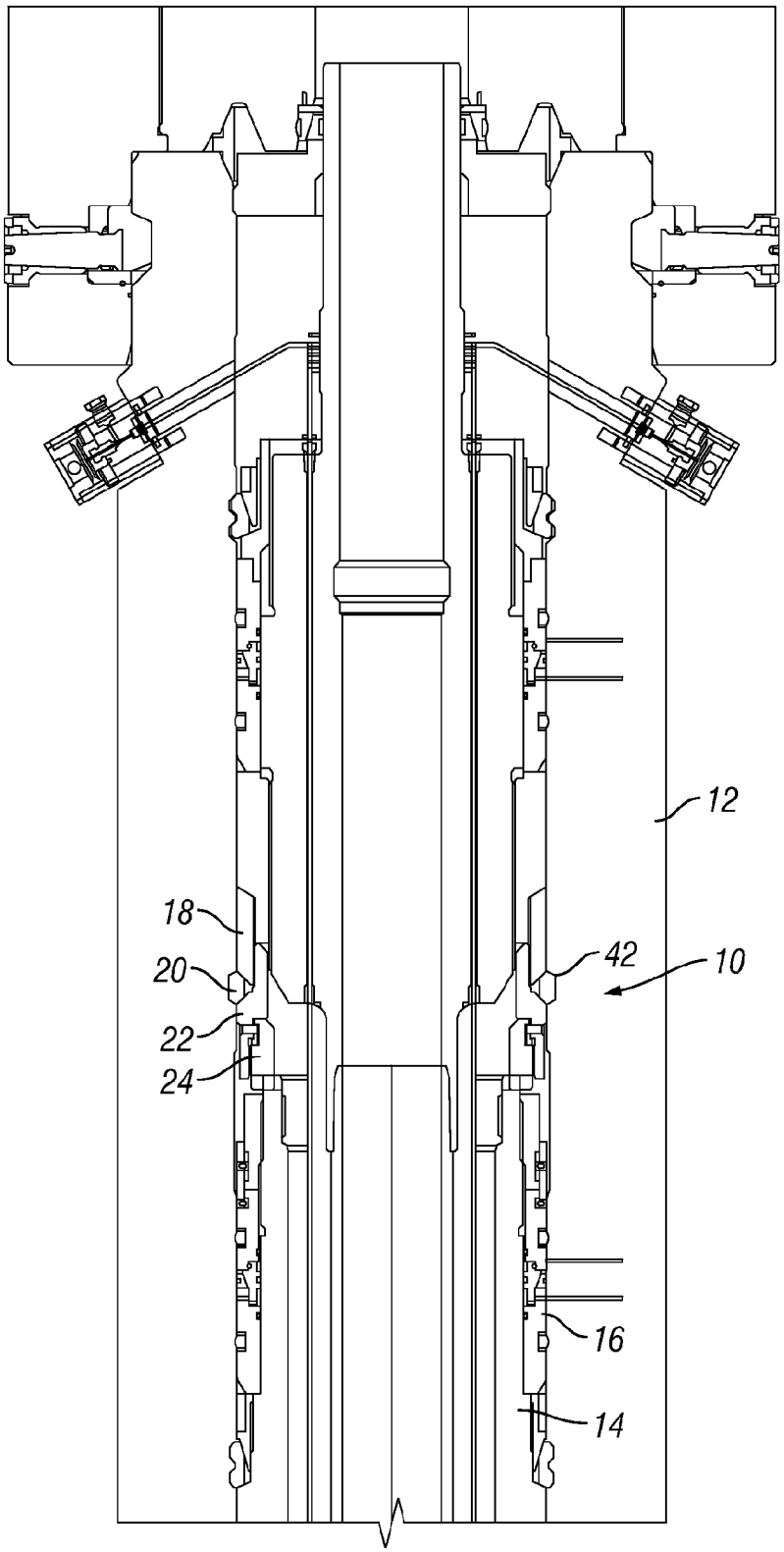
FIG. 1 is cross section view of a loading shoulder installed in a wellhead housing above a previously installed casing hanger and packoff assembly.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Figure 2:
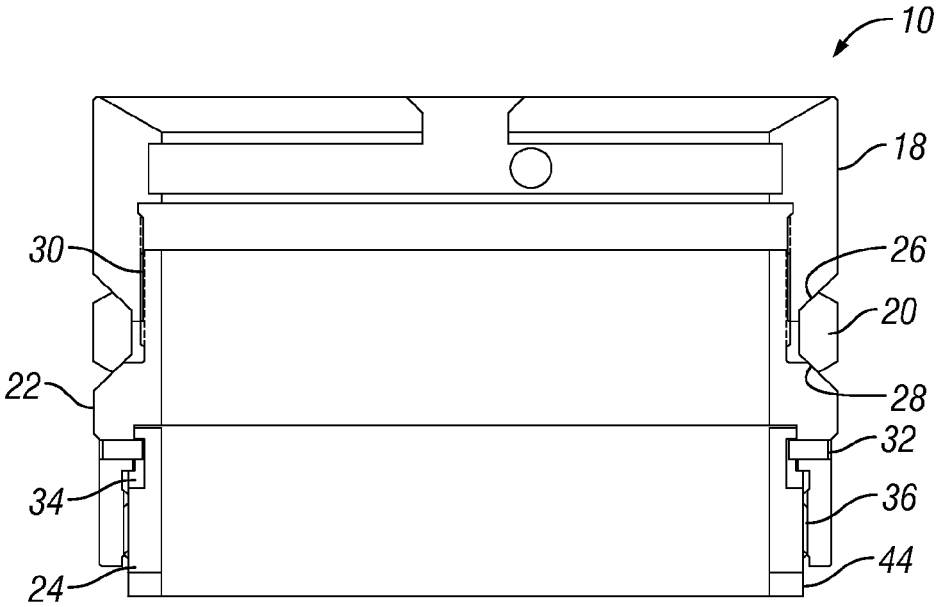
FIG. 2 is a cross section view of a close up of the loading shoulder of FIG. 1.

Referring to FIGS. 1 and 2, a loading shoulder 10 is shown installed in a wellhead housing 12 above a previously installed casing hanger 14 and packoff assembly 16. The loading shoulder 10 includes an energizing ring 18, a lock ring 20, a loading ring 22, and a hold-down ring 24. The loading shoulder 10 typically includes only metal components. However, the loading shoulder 10 may also include non-metal components that are capable of providing support for a casing hanger. As shown, the lock ring 20 is positioned externally to and in between the energizing ring 18 and the loading ring 22. Also, the energizing ring 18, the lock ring 20, and the loading ring 22 include angled surfaces for sliding engagements at 26 and 28, respectively. The lock ring 20 is also expandable and may either be a segmented ring, a "C" ring, or any other suitable expandable configuration. Further, the lock ring 20 is shown in a configuration for engaging a corresponding lock ring groove 42 in the wellhead. It should be appreciated, however, that the lock ring 20 and the lock ring groove 42 may be any suitable configuration for proper locking engagement of the loading shoulder 10. Additionally, the energizing ring 18 and the loading ring 22 overlap in a loading ring threaded connection 30 with the loading ring 22 threaded into the energizing ring 18.

Opposite the portion threaded into the energizing ring 18, a catch ring 32 extends from an interior surface of the loading ring 22 into an annular groove 34 on the outside surface of the hold-down ring 24. Although the catch ring 32 is secured to the loading ring 22, the size of the groove 34 allows both vertical and rotational movement of the hold-down ring 24 relative to the loading ring 22. However, the catch ring 32 only allows a certain amount of vertical travel of the hold-down ring 24 relative to the loading ring 22 before the catch ring 32 engages an edge of the groove 34.

In addition to the catch ring 32, the loading ring 22 interacts with the hold-down ring 24 through a hold-down ring threaded connection 36. The direction of the threads of the hold-down ring threaded connection 36 may either be right-handed or left-handed. However, the threads of the hold-down ring threaded connection 36 are an opposite turn than the threads of the loading ring threaded connection 30. Thus, if the loading ring threaded connection 30 threads are right-hand threads, the hold-down ring threaded connection 36 will include left-hand threads and vice versa.

Figure 3:
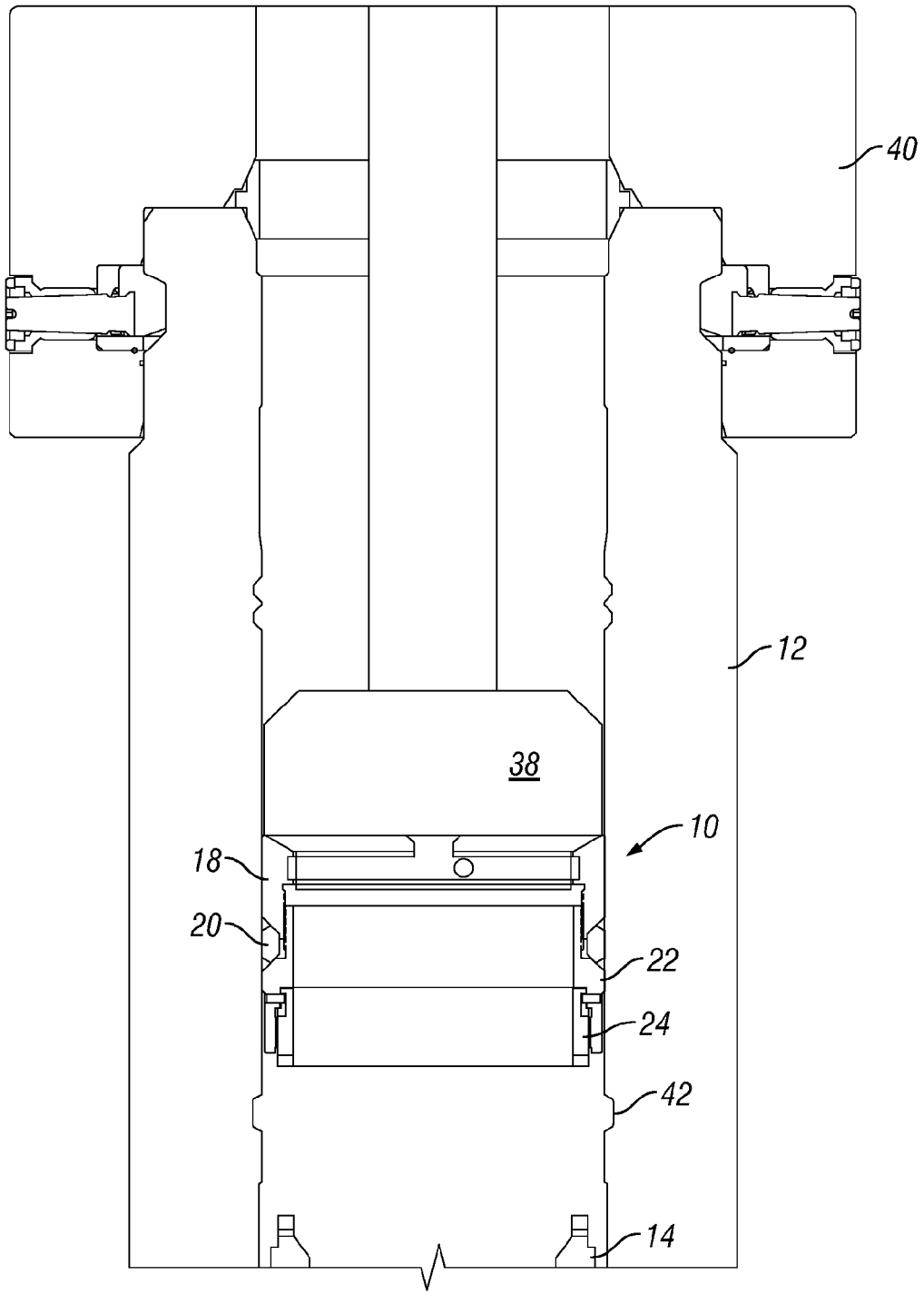
FIG. 3 is a cross section of a running tool and a loading shoulder being run into the wellhead housing.

FIG. 3 illustrates the loading shoulder 10 being run into a wellhead housing 12 for landing on a previously installed casing hanger 14 and packoff assembly 16. The loading shoulder 10 is run into the wellhead housing 12 using a loading shoulder running tool 38 connected to a drill string or other pipe string. As shown, the landing shoulder 10 is in the unset position and as such may be configured to be run though a blowout preventer stack 40 attached above the wellhead housing 12. The running tool 38 is used to land the loading shoulder 10 onto a previously installed casing hanger 14 with both the loading ring 22 and the lock ring 20 in the unset position. When landed, the lock ring 20 is aligned with a corresponding lock ring groove 42 in the wellhead housing 12. Additionally, the lower portion of the hold-down-down ring 24 engages the upper portion of the previously installed casing hanger 14 in a tongue-and-groove arrangement 44 that restrains relative rotation between the hold-down ring 24 and the casing hanger 14. It should be appreciated, however, that any arrangement suitable for restraining relative rotation may be used.

Figure 4:
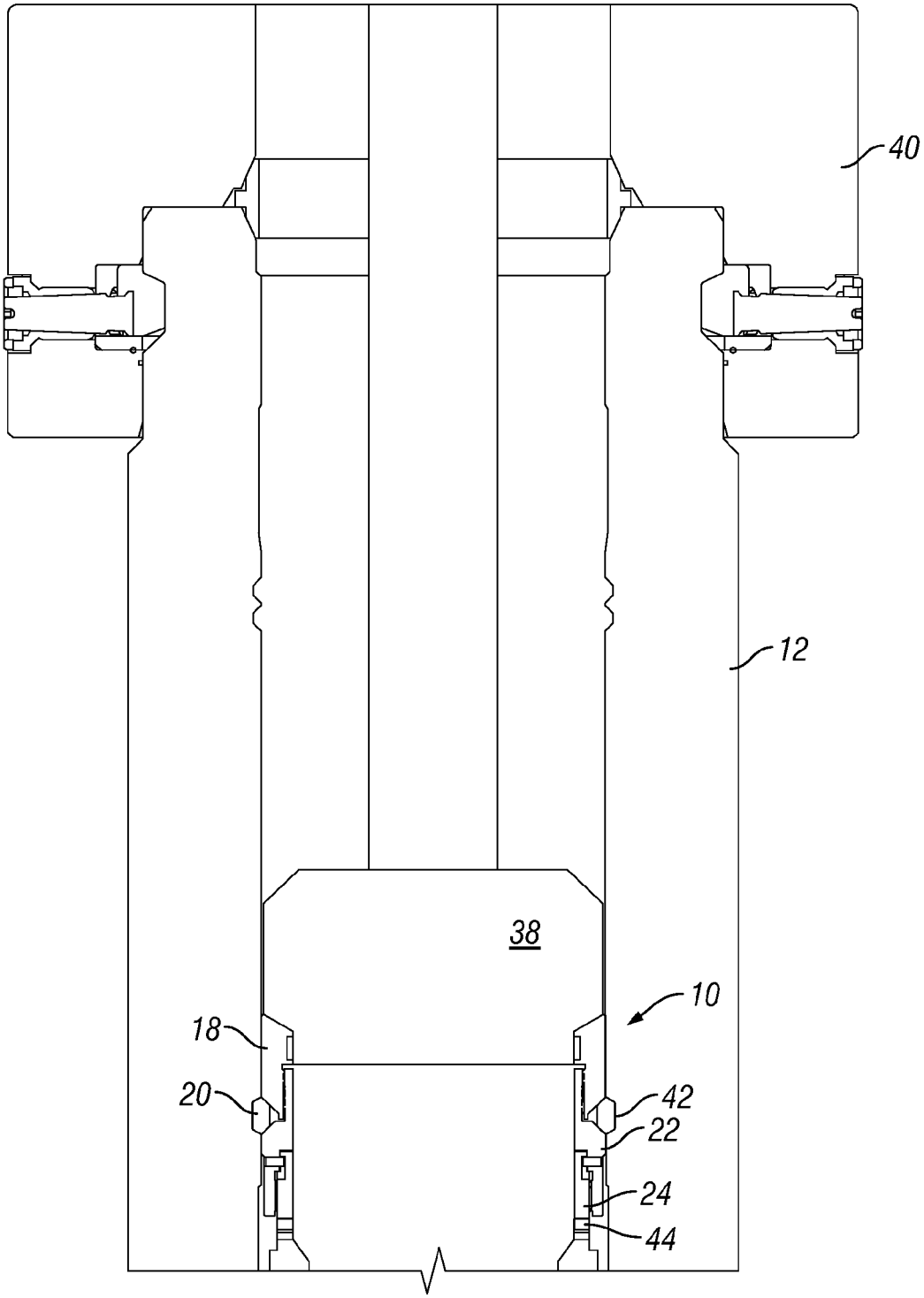
FIG. 4 is a cross section view of the loading shoulder landed onto the previously installed casing hanger with the loading ring and the lock ring in the set position.

To set the loading shoulder 10, the running tool 38 rotates the energizing ring 18. Because of the tongue-and-groove engagement 44, both the hold-down ring 24 and the loading ring 22 resist being rotated with the energizing ring 18. Consequently, the energizing ring 18 rotates relative to the loading ring 22 and the hold-down ring 24. Because of the loading ring threaded connection 30, the rotation of the energizing ring 18 relative to the loading ring 22 draws the loading ring 22 further into the energizing ring 18. Doing so actuates the lock ring angled engagements 26, 28 to expand the lock ring 20 into engagement with the lock ring groove 42 in the wellhead 12 as shown in FIG. 4.

Rotation of the energizing ring 18 relative to the loading ring 22 proceeds until either the loading ring threaded connection 30 bottoms out or the lock ring 20 becomes fully expanded into the wellhead lock ring groove 42. At such time, the loading ring 22 no longer rotates relative to the energizing ring 18 and begins to rotate with the energizing ring 18. However, the tongue-and groove arrangement 44 still restrains the hold-down ring 24 from rotating, thus producing relative rotation between the loading ring 22 and the hold-down ring 24 with the catch ring 32 rotating within the annular groove 34.

As previously mentioned, the threads of the hold-down ring threaded connection 36 turn in a different direction than the threads of the loading ring threaded connection 30. Thus, although the energizing ring 18 rotation direction draws the loading ring 22 further into the energizing ring 18, the same rotation direction expands the hold-down ring 24 out from the loading ring 22. Thus, rotation of the loading ring 22 as described expands the hold-down ring 24 out from the loading ring 22 to restrain movement of the casing hanger 14 as well as the packoff assembly 16 below.

Figure 5:
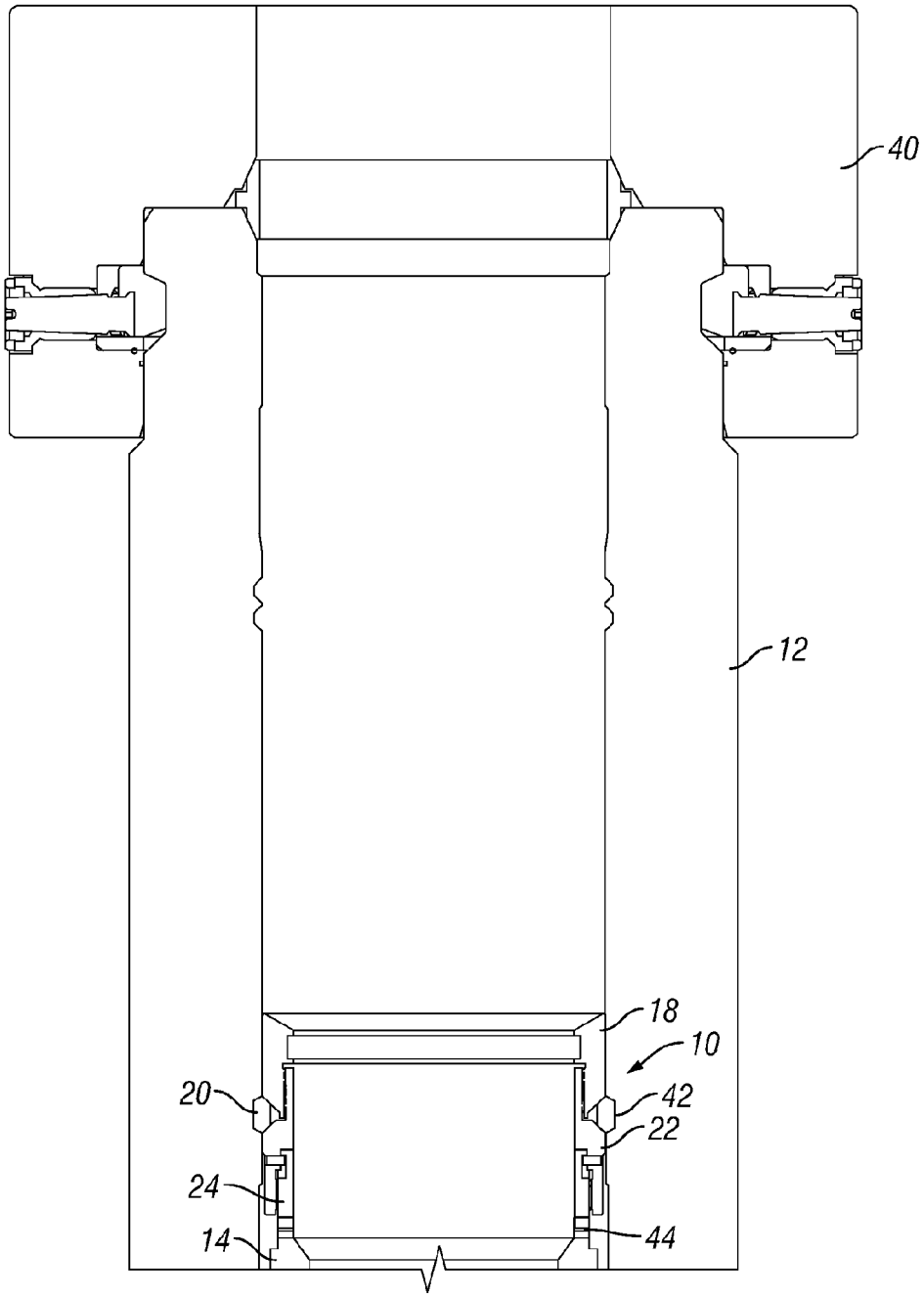
FIG. 5 is cross section view of the loading shoulder locked in position with the running tool removed.

As shown in FIG. 5, once the loading shoulder 10 is set, the running tool 38 may then be disengaged from the loading shoulder 10 and retrieved from the wellhead housing 12. Further drilling, completion, or other well operations may then proceed.

Figure 6:
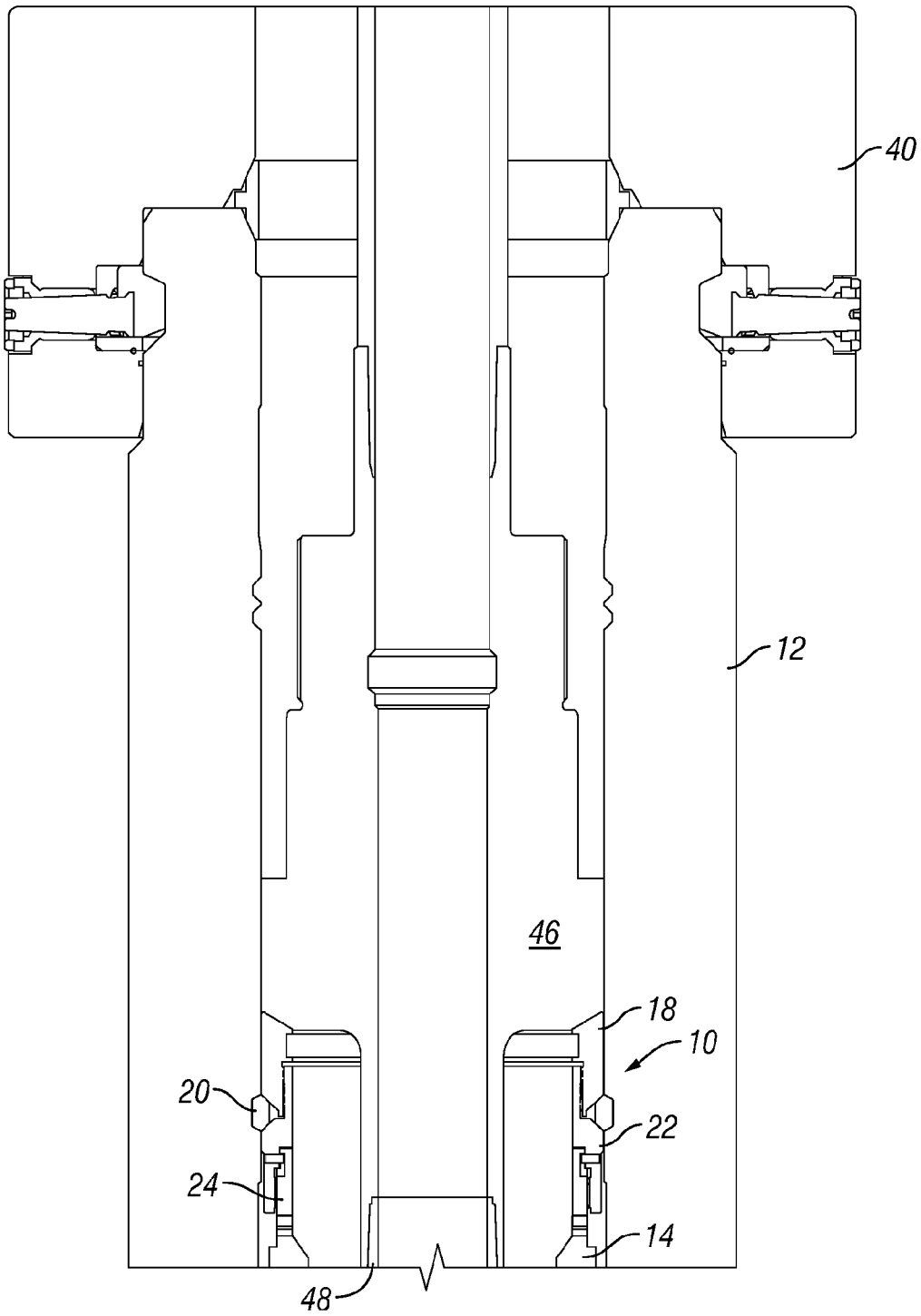
FIG. 6 is a cross section of a casing hanger landed on the loading shoulder.
Figure 7:
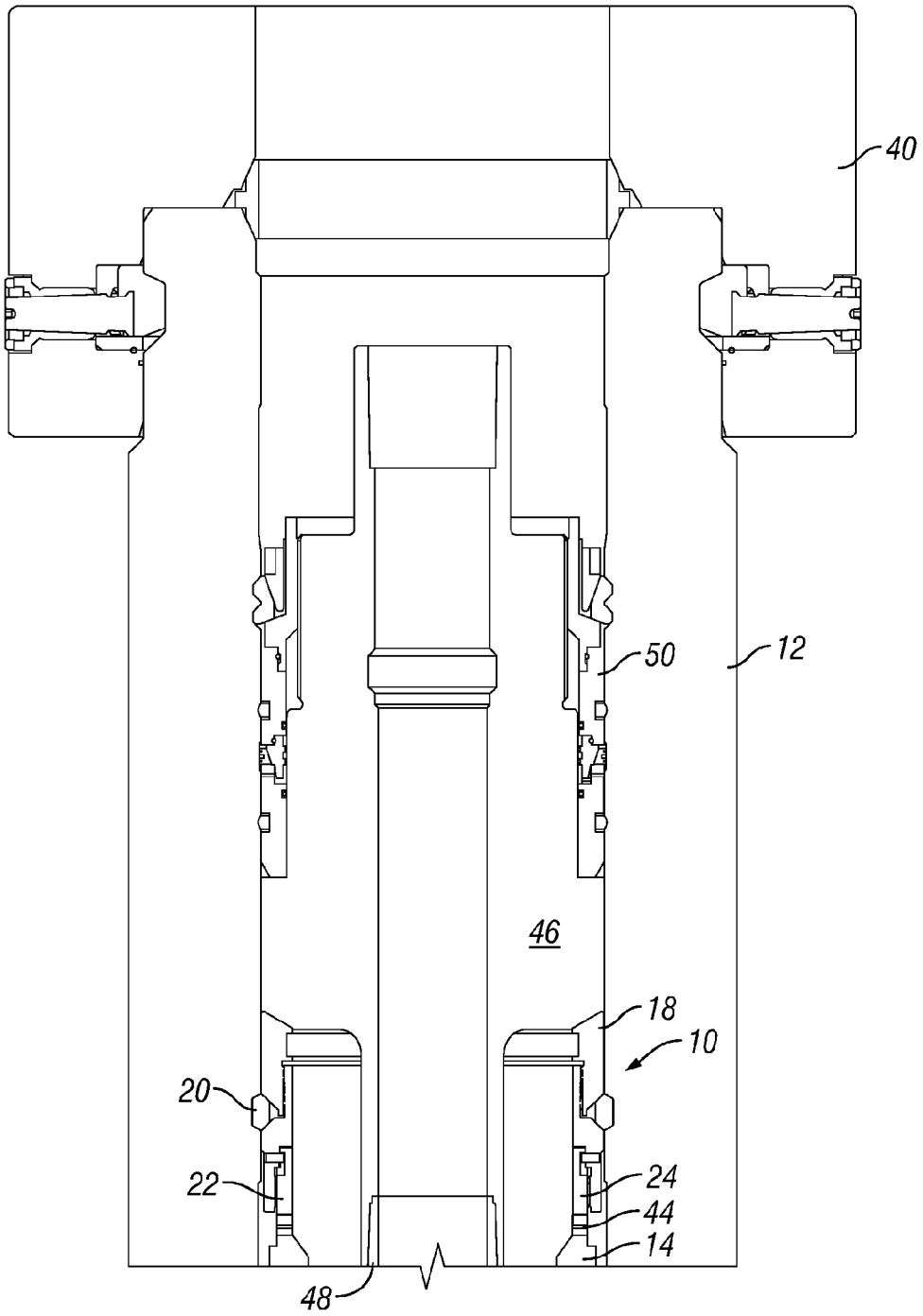
FIG. 7 is a cross section of a packoff assembly installed on the casing hanger of FIG. 6.

As shown in FIGS. 6 and 7, the loading shoulder 10 provides a bi-directional loaded shoulder for the installation of an additional casing hanger 46 that is run into the wellhead 12 and landing on the loading shoulder 10. When landed, the weight of the casing hanger 46 and the casing string 48 may thus be transferred at least in part to the wellhead housing 12 through the loading shoulder 10. As shown in FIG. 7, an additional packoff assembly may also be installed to form a seal between the additional casing hanger 46 and the wellhead 12.

The loading shoulder 10 may thus provide a positive lock in both the direction extending into the wellbore and the direction extending out of the wellbore to support an additional casing hanger 46 above as well as restrain the casing hanger 14 and packoff assembly 16 below.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. An apparatus for installation of a casing string in a wellhead comprising a wellhead bore using a running tool, the apparatus comprising:

an energizing ring rotatable by the running tool;

a loading ring threaded into an energizing ring interior with a first thread turn in a first direction;

a lock ring supported between an energizing ring exterior and the loading ring, the lock ring being moveable between an unset and a set position;

a hold-down ring threaded into a loading ring interior with a second thread turn in a second direction opposite the first thread turn first direction, the hold-down ring also comprising an engagement surface for preventing rotation of the hold-down ring and restraining rotation of the loading ring;

wherein the lock ring is moveable into bi-directional supporting engagement with the wellhead in the set position upon rotation of the energizing ring in a rotational direction to move the loading ring axially into the energizing ring; and wherein the hold-down ring is moveable axially out of the loading ring upon rotation of the loading ring in the rotational direction by the energizing ring.

2. The apparatus of claim 1, further comprising:

a hold down ring exterior surface comprising an annular groove; and the loading ring further comprising a catch ring extending from a loading ring interior surface into the annular groove, the annular groove allowing a defined amount of both vertical and rotational movement of the hold-down ring relative to the loading ring.

3. The apparatus of claim 1, wherein at least one of the bottoming out of the loading ring threaded connection with the energizing ring and the lock ring becoming fully engaged with the wellhead sufficiently engages the 1 energizing ring and the loading ring to overcome the rotation restraint from the hold-down ring on the loading ring.

4. The apparatus of claim 1, wherein the connection between the energizing ring and the loading ring in the first direction and the connection between the loading ring and the hold-down ring in the second direction allow rotation of the energizing ring in one direction to both move the loading ring axially into the energizing ring and move the hold-down ring axially out of the loading ring.

5. The apparatus of claim 1, wherein the lock ring is moveable into a groove in the wellhead bore in the set position such that a lock ring outer diameter is greater than a wellhead bore diameter.

6. A method for installing casing strings in a wellhead comprising a wellhead bore, the method comprising:

installing a first casing string and first packoff in the wellhead bore, the first casing string being supported from a first casing hanger landed on a shoulder in the wellhead bore;

landing a loading shoulder assembly onto the first casing hanger using a running tool such that the first casing hanger prevents rotation of a first portion of the loading shoulder assembly;

moving a lock ring of the loading shoulder assembly from an unset position into bi-directional supporting engagement with the wellhead in a set position by rotating a second portion of the loading shoulder assembly with the running tool in a rotational direction;

axially extending the first portion of the loading shoulder assembly into restraining engagement with the first casing hanger by rotating the second portion of the loading shoulder assembly with the running tool in the rotational direction;

removing the running tool from the wellhead; and installing a second casing string in the wellhead bore, the second casing string being supported from a second casing hanger landed on the loading shoulder assembly.

7. The method of claim 6, wherein moving the lock ring and axially extending the first portion of the loading shoulder assembly further includes providing bi-directional loading support in the wellhead bore by restraining the first casing hanger in a first direction and supporting the second casing hanger in a second direction.

8. The method of claim 6, wherein moving the lock ring by rotating the second portion of the loading shoulder assembly includes rotating an energizing ring with the running tool relative to a loading ring restrained from rotation, the loading ring threaded into an energizing ring interior with a first thread turn in a first direction such that rotating the running tool moves the loading ring axially into the energizing ring.

9. The method of claim 8, wherein axially extending the first portion of the loading shoulder assembly includes, upon sufficient engagement between the energizing ring and the loading ring to overcome the rotation restraint from the first portion, rotating the energizing ring and the loading ring to extend a hold-down ring out of the loading ring, the hold-down ring threaded into a loading ring interior with a second thread turn in a second direction opposite the first thread first direction.

10. The method of claim 9, further comprising allowing a defined amount of both vertical and rotational movement of the hold-down ring relative to the loading ring by restraining a catch ring extending from an interior surface of the loading ring in an annular groove in a hold-down ring exterior surface.

11. The method of claim 9, wherein producing sufficient engagement between the energizing ring and the loading ring to overcome the rotation restraint on the loading ring from the first portion further includes at least one of bottoming out the loading ring against the energizing ring or fully engaging the lock ring with the wellhead.

12. The method of claim 9, wherein the threaded connection between the energizing ring and the loading ring in the first thread direction and the threaded connection between the loading ring and the hold-down ring in the second thread direction allow rotation of the energizing ring in one direction to both move the loading ring axially into the energizing ring and move the hold-down ring axially out of the loading ring.

13. The method of claim 6, wherein the lock ring is moveable into a groove in the wellhead bore in the set position such that a lock ring outer diameter is greater than the wellhead bore diameter.

14. A well production system at least partially installable using a running tool, the system comprising:

a wellhead comprising a wellhead bore;

a first casing string and first packoff landed the wellhead bore, the first casing string being supported from a first casing hanger landed on a shoulder in the wellhead bore;

a loading shoulder assembly installable in the wellhead, the loading shoulder assembly comprising:

an energizing ring rotatable by the running tool;

a loading ring threaded into an energizing ring interior with a first thread turn in a first direction;

a lock ring supported between an energizing ring exterior and the loading ring, the lock ring being moveable between an unset and a set position;

a hold-down ring threaded into a loading ring interior with a second thread turn in a second direction opposite the first thread turn first direction, the hold-down ring also comprising an engagement surface for engagement with the first casing hanger to prevent rotation of the hold-down ring and restrain rotation of the loading ring;

wherein the lock ring is moveable from the unset position into supporting engagement with the wellhead in the set position upon rotation of the energizing ring in a rotational direction to move the loading ring axially into the energizing ring;

wherein the hold-down ring is moveable axially out of the loading ring upon rotation of the loading ring in the rotational direction by the energizing ring; and wherein the lock ring is engageable with the wellhead in the set position to provide bi-directional loading support in the wellhead bore such that the first casing hanger is restrained from movement out of the wellhead in a first direction and the loading shoulder assembly is capable of supporting a second casing string supported by a second casing hanger landed on the loading shoulder assembly.

15. The system of claim 14, further comprising:

a hold down ring exterior surface comprising an annular groove; and the loading ring further comprising a catch ring extending from a loading ring interior surface into the annular groove, the annular groove allowing a defined amount of both vertical and rotational movement of the hold-down ring relative to the loading ring.

16. The system of claim 14, wherein at least one of the bottoming out of the loading ring threaded connection with the energizing ring and the lock ring becoming fully engaged with the wellhead sufficiently engages the energizing ring and the loading ring to overcome the rotation restraint from the hold-down ring on the loading ring.

17. The system of claim 14, wherein the connection between the energizing ring and the loading ring in the first direction and the connection between the loading ring and the hold-down ring in the second direction allow rotation of the energizing ring in one direction to both move the loading ring axially into the energizing ring and move the hold-down ring axially out of the loading ring.

18. The system of claim 14, wherein the lock ring is moveable into a groove in the wellhead bore in the set position such that a lock ring outer diameter is greater than a wellhead bore diameter.

* * * * *